US006102117A

United States Patent [19]

Swor et al.

[11] Patent Number: 6,102,117

[45] Date of Patent: Aug. 15, 2000

[54] RETRIEVABLE HIGH PRESSURE, HIGH TEMPERATURE PACKER APPARATUS WITH ANTI-EXTRUSION SYSTEM

[75] Inventors: Loren C. Swor, Duncan; Lee Wayne Stepp, Comanche; Donald W. Winslow, Duncan, all of Okla.

[73] Assignee: Halliburton Energy Services, Inc., Duncan, Okla.

[21] Appl. No.: 09/083,304

[22] Filed: May 22, 1998

[51] Int. Cl.[7] ..... E21B 33/12

[52] U.S. Cl. ..... 166/138; 166/217; 166/387; 166/196

[58] Field of Search ..... 166/134, 138, 166/196, 217, 387

[56] References Cited

U.S. PATENT DOCUMENTS

| | | | |
|---|---|---|---|
| 4,176,715 | 12/1979 | Bigelow et al. | 166/138 |
| 4,457,369 | 7/1984 | Henderson | 166/134 X |
| 5,277,253 | 1/1994 | Giroux et al. | 166/187 |
| 5,311,938 | 5/1994 | Hendrickson et al. | 166/134 |
| 5,348,087 | 9/1994 | Williamson, Jr. | 166/115 |
| 5,390,735 | 2/1995 | Williamson, Jr. | 166/115 |
| 5,400,855 | 3/1995 | Stepp et al. | 166/151 |
| 5,433,269 | 7/1995 | Hendrickson | 166/134 |
| 5,526,878 | 6/1996 | Duell et al. | 166/187 |
| 5,603,511 | 2/1997 | Keyser, Jr. et al. | 277/115 |
| 5,701,954 | 12/1997 | Kilgore et al. | 166/119 |
| 5,701,959 | 12/1997 | Hushbeck et al. | 166/387 |

*Primary Examiner*—Roger Schoeppel
*Attorney, Agent, or Firm*—Stephen R. Christian; Anthony L. Rahhal

[57] ABSTRACT

A packer apparatus for sealing between a tubing string and a casing in a wellbore is disclosed. The packer apparatus includes a seal assembly disposed about a packer mandrel. Upper and lower seal wedges are disposed about the packer mandrel above and below the seal assembly and may be inserted between the seal assembly and the packer mandrel to radially expand the seal assembly into engagement with the casing. The seal assembly includes an expandable elastomeric seal element having anti-extrusion bridge elements disposed in recesses at the upper and lower ends thereof. The anti-extrusion elements form an almost complete circle and thus are arcuately shaped having first and second ends with a gap therebetween. The anti-extrusion bridge elements are preferably automatically radially retractable elements so that when the seal wedges are removed from between the seal assembly and the packer mandrel, the automatically radially retractable anti-extrusion elements will apply a radially inwardly directed force sufficient to cause the seal assembly to radially retract and close around the packer mandrel.

24 Claims, 15 Drawing Sheets

RETRIEVABLE HIGH PRESSURE, HIGH TEMPERATURE PACKER APPARATUS WITH ANTI-EXTRUSION SYSTEM

BACKGROUND OF THE INVENTION

The present invention relates generally to an expandable seal assembly for sealing an annulus between a substantially cylindrical object and a bore of a surrounding cylindrical casing or wall. More particularly, the present invention relates to a packer apparatus with an expandable seal assembly having anti-extrusion jackets for providing a seal between the packer apparatus and the casing in a wellbore, and to prevent sealing element extrusion at high temperatures and pressures.

It is well known that in the course of treating and preparing subterranean wells for production, a well packer is run into a wellbore on a work string or production tubing. The purpose of the packer is to support the work string or production tubing and other completion equipment such as a screen adjacent a producing formation, and to seal the annulus between the outside of the work string or production tubing and the inside of the well casing to prevent movement of fluid through the annulus past the packer location. Various packers are shown in U.S. Pat. No. 5,311,938 to Hendrickson et al., issued May 17, 1994, U.S. Pat. No. 5,433,269 to Hendrickson et al., issued Jul. 18, 1995, and U.S. Pat. No. 5,603,511 issued to Kaiser et al., issued Feb. 8, 1997, the details of all of which are incorporated herein by reference. The packer apparatus typically carries annular seal elements which are expandable into sealing engagement against the bore of the well casing. The seal elements shown in U.S. Pat. Nos. 5,311,938 and 5,348,087 expand radially in response to axial compressive forces while the seal assembly shown in U.S. Pat. No. 5,603,511 is set into sealing engagement by applying a radially outward force to the inner diameter of the seal element which causes the seal element to expand radially outwardly into sealing engagement with the casing.

The Kaiser et al. patent discloses a radially expandable seal assembly that is designed to maintain sealing engagement at temperatures and pressures around 325° F. and 10,000 psi. Because the packer apparatus may often experience pressures and temperatures as high as 15,000 psi and 400° F., a need exists for a retrievable seal assembly that will prevent seal element extrusion and blowout at the casing wall and will maintain a reliable seal between the tubing string and the well casing at a temperature of 400° F. and a differential pressure of 15,000 psi.

SUMMARY OF THE INVENTION

The present invention provides a retrievable packer apparatus that can be moved into a set position from a running position several times in a wellbore and can maintain sealing engagement with the casing disposed in the wellbore each time it is set at a temperature as high as 400° and a pressure as high as 15,000 psi.

The packer apparatus includes a packer mandrel having an outer surface. A seal assembly is disposed about the outer surface of the packer mandrel. An upper seal wedge and lower seal wedge are disposed about the packer mandrel and, in the running position, the upper seal wedge is positioned above the seal assembly and the lower seal wedge is positioned below the seal assembly. When the packer apparatus is in the running position, wherein the packer may be lowered or raised in a wellbore, a gap exists between the casing inner surface and the outer surface of the seal assembly. To radially expand the seal assembly outwardly into sealing engagement with the casing, the packer apparatus is moved from the running to the set position. To do so, the packer mandrel is moved downwardly with respect to the seal assembly, which causes the upper and lower seal wedges to slide between the packer mandrel outer surface and an inner surface of the seal assembly to radially expand the seal assembly outwardly. The seal wedges are capable of radially expanding the seal and are also capable of imparting axial compressive forces into the seal assembly so that the combined radially outward forces and the compressive forces imparted into the seal assembly by the upper and lower seal wedges expand the seal sufficiently such that the seal assembly will maintain sealing engagement with the casing at a temperature as high as 400° F. and a pressure as high as 15,000 psi.

The seal assembly includes a generally cylindrical sealing element and generally annular anti-extrusion jackets received in recesses defined at the upper and lower ends of the sealing element. The recesses extend radially inwardly from the outer surface of the sealing element and intersect the upper and lower ends thereof, so that each recess is generally L-shaped. The anti-extrusion jackets have a generally rectangular cross section and are received in the recesses. The anti-extrusion jackets have a circumferential gap therein so that when the seal assembly is expanded into the set position, the gap in the anti-extrusion jackets expand. A bridge element is received in the recesses between a portion of the anti-extrusion jackets and the sealing element, and is generally in alignment with the gap in the jackets so that when the seal expands, the anti-extrusion jackets and the bridge element will contact the outer wall around the entire outer circumference of the seal element at the upper and lower ends thereof to prevent extrusion. Thus, the anti-extrusion jacket and the bridge element together function as a backup to prevent extrusion. The anti-extrusion jackets are preferably automatically radially retractable and cause the seal assembly to radially retract inwardly when the packer apparatus is moved from the set to the running position.

BRIEF DESCRIPTION OF THE DRAWINGS

FIGS. 1A–1F show a partial cross-section elevation view of the packer apparatus of the present invention in a running position.

FIGS. 2A–2F show a partial cross-section elevation view of the packer apparatus of the present invention in a set position.

DETAILED DESCRIPTION OF THE PREFERRED EMBODIMENT

Certain terminology may be used in the following description for convenience only and is not limiting. For instance, the words "inwardly" and "outwardly" are directions toward and away from, respectively, the geometric center of a referenced object.

Figure 9A:
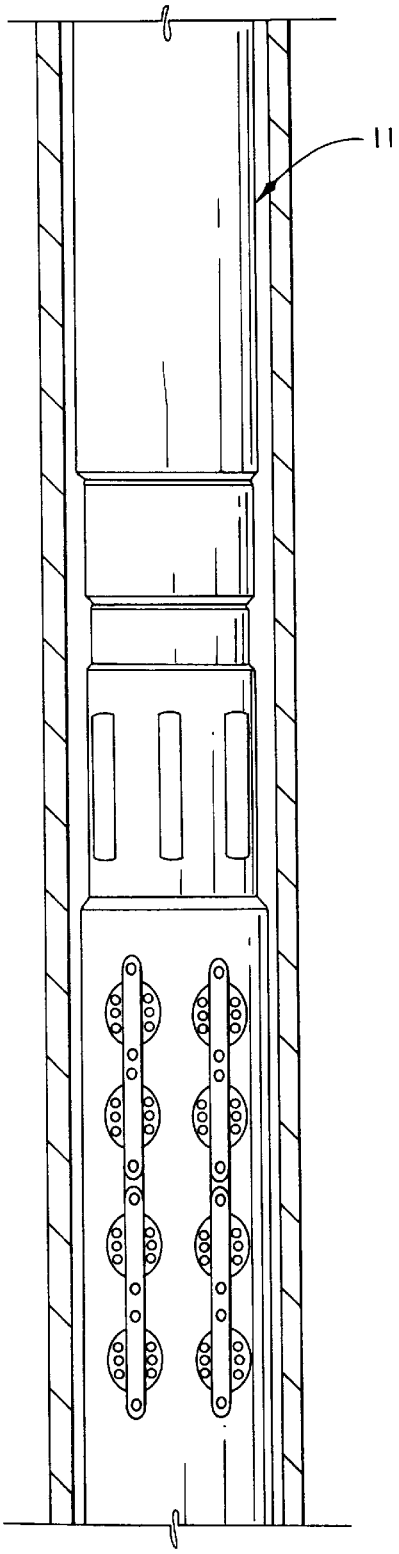
FIGS. 9A and 9B show a schematic portion of the packer apparatus set in a casing disposed in a wellbore.
Figure 9B:
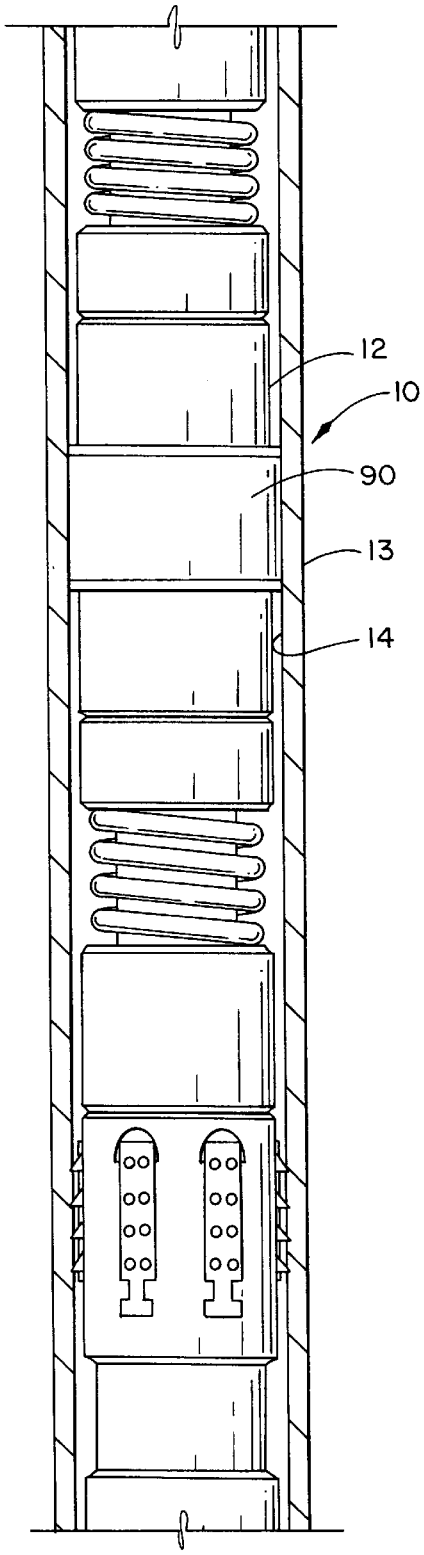

Referring now to the drawings and more specifically to FIGS. 1A–1F and 2A–2F, a packer apparatus 10 is shown. Packer apparatus 10 is shown schematically in FIGS. 9A and 9B as part of a tubing string 11 disposed in a wellbore 12. Wellbore 12 has a casing 13 with an inner surface 14 disposed therein. Packer apparatus 10 may have an upper end 15 which has internal threads 16 defined thereon adapted to be connected to tubing string 11 which extends thereabove, and may further include a lower end 20 having threads 21 defined thereon for connecting with tubing string 11 which will extend therebelow. Thus, packer apparatus 10 is adapted to be connected to and made up as part of a tubing string 11.

Tubing string 11 above and below packer apparatus 10 may be production tubing or any other known work or pipe string, and may include any kind of equipment and/or tool utilized in the course of treating and preparing wells for production. It is also understood that the packer apparatus 10 will support production tubing and other production equipment such as a screen adjacent a producing formation and will seal the annulus between the outside of the production tubing and the inside of a well casing disposed in a wellbore. Packer apparatus 10 defines a central flow passage 32 for the communication of fluids through packer apparatus 10 and tubing string 11 thereabove and therebelow.

FIGS. 1A–1F show packer apparatus 10 in a first or running position 25 and FIGS. 2A–2F show packer apparatus 10 in a second or set position 30. FIGS. 1C, 1E, 2C and 2E schematically show a cross section of casing 13. It is understood that casing 13 extends in a downward and upward direction in wellbore 12, but is not shown in FIGS. 1A, 1B, 1D, 1F, 2A, 2B, 2D and 2F for the sake of clarity.

Packer apparatus 10 includes a packer mandrel 35 with an upper end 40 and a lower end 45. Lower end 45 comprises lower end 20 of the packer apparatus and has threads 21. Upper end 40 may be threadably connected to a hydraulic hold-down assembly 50 which has threads 16 defined therein adapted to be connected to the tubing string, thereby adapting packer mandrel 35 to be connected in tubing string 11. Packer mandrel 35 may comprise an upper packer mandrel 55 and a lower packer mandrel 60.

Upper packer mandrel 55 has an upper end 62 and a lower end 64 which may be threadedly connected to lower packer mandrel 60 at its upper end 66 thereof. Lower packer mandrel 60 has a lower end 67. Upper mandrel 55 has first, second and third inner surfaces 68, 70 and 72 defining first, second and third diameters 74, 76 and 78, respectively. Inner surface 70 is recessed radially inwardly from surface 68, and surface 72 is recessed radially inwardly from surface 70. A volume tube 80 is sealingly received in second inner surface 70 near the lower end 64 of upper packer mandrel 55. Volume tube 80 extends upwardly through upper mandrel 55 and sealingly engages an inner surface 82 of hydraulic hold-down assembly 50. Volume tube 80 thus defines a portion of central flow passage 32 which extends longitudinally through packer apparatus 10.

Upper packer mandrel 55 has an outer surface 86 defined thereon defining a first outer packer diameter 88. Outer surface 86 may also be referred to as a seal-supporting surface 86. Packer apparatus 10 further includes a radially expandable seal assembly 90 disposed about packer mandrel 35. As shown in FIGS. 1A–1F, seal assembly 90 is closely received about outer packer surface 86.

Seal assembly 90 has an outer or first axial surface 92 and an inner or second axial surface 94 defining inner diameter 93. A gap 95 exists between first axial surface 92 and casing 13 when packer apparatus 10 is in running position 25. Seal assembly 90 also has a first or upper end 96 and a second or lower end 98 with a length 99 therebetween. First end 96 defines a first or upper radial surface 100 and second end 98 defines a second or lower radial surface 102. Inner surface 94 of seal assembly 90 is closely received about and preferably engages outer packer surface, or seal-supporting surface 86 along the entire length 99 thereof when packer apparatus 10 is in running position 25.

Seal assembly 90 may comprise a sealing element 104 having a outer or first axial surface 106 and a second or inner axial surface 108. Sealing element 104 is preferably formed from an elastomeric material such as, but not limited to, NBR, FKM, VITON® or the like. However, one skilled in the art will recognize that depending on the temperatures and pressures to be experienced, other materials may be used without departing from the scope and spirit of the present invention.

Sealing element 104 has a first or upper end 110 and a second or lower end 112. First end 110 defines a first or upper radial surface 114 and second end 112 defines a second or lower radial surface 116. Seal assembly 90 further includes anti-extrusion jackets 117 which may comprise a first or upper anti-extrusion jacket or element 118 and a second or lower anti-extrusion jacket or element 120.

The details of the anti-extrusion jackets are shown in FIGS. 3, 5, 6 and 8. As shown therein, anti-extrusion jackets 118 and 120 are substantially identical in configuration, and so will be referred to collectively as anti-extrusion jackets or elements 117. As will be explained hereinbelow, however, the radial position of the upper jacket 118 in seal assembly 90 is different from the radial position of the lower jacket 120. Anti-extrusion jackets 117 are circular, or ring shaped, but do not form a complete circle. Jackets 117 are thus arcuately shaped anti-extrusion jackets having first and second ends 122 and 124 defining a gap 123 therebetween. Anti-extrusion jackets 117 may also be defined or described as toroid or doughnut shaped having a circumferential gap or split 123 therein which defines first and second ends 122 and 124.

Figure 6:
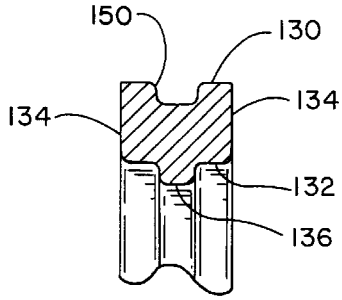
FIG. 6 shows a cross-sectional view from lines 6—6.

As shown in FIG. 6, anti-extrusion jackets 117 have a generally rectangularly shaped cross section with outer surface 130, inner surface 132 and opposed side surfaces 134. Anti-extrusion jackets 117 may have first and second tongues 136 and 138, respectively, extending radially inwardly from inner surface 132. First tongue 136 has a first end 140 and a second end 142. Second tongue 138 has a first end 144 and a second end 146. First ends 140 and 144 of first and second tongues 136 and 138 have an arc length 148 therebetween which preferably is greater than 60° but less than 70°, but may vary and be less or greater than 60°–70° depending on the diameter of the jackets. A groove 150 is defined in outer surface 130 and preferably extends from first end 122 around the entire circumference of anti-extrusion jackets 117 to second end 124.

Preferably, outer surface 130 of anti-extrusion jackets 117 is coextensive with outer surface 106 of sealing element 104 so that surfaces 106 and 130 comprise outer surface 92 of seal assembly 90. Additionally, the exposed surfaces 134 of jackets 117 are preferably coextensive with the upper and lower radial surfaces 114 and 116 of sealing element 104. Thus, exposed surfaces 134 and radial surfaces 114 and 116 of sealing element 104 define upper and lower radial surfaces 100 and 102 of seal assembly 90.

Figure 4:
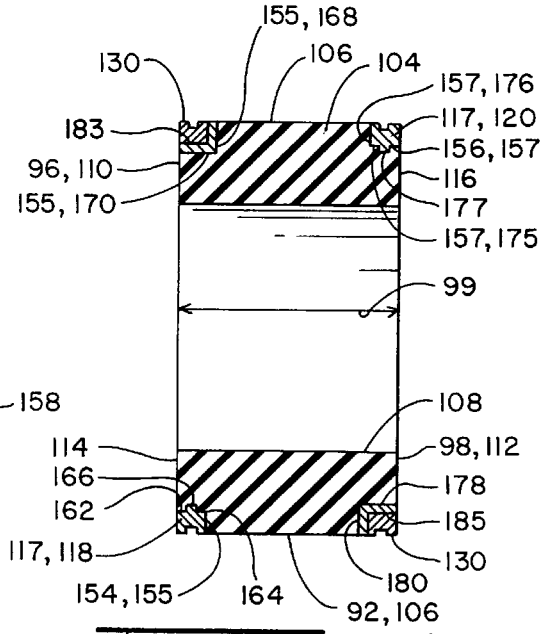
FIG. 4 shows a section view taken from lines 4—4 of FIG. 3.
Figure 5:
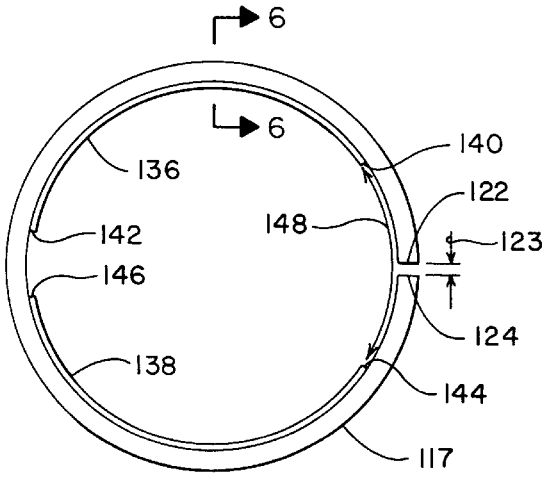
FIG. 5 shows a plan view of an anti-extrusion element of the present invention.

Referring now to FIG. 4, anti-extrusion jackets 117 are received in recesses 152 defined in sealing element 104. Recesses 152 which may be referred to as circumferential recesses, comprise a first or upper recess 154 and a second or lower recess 156. First recess 154 defines a first recessed surface 155 and second recess 156 defines a second recessed surface 157. Recess 154 has a first arcuate portion 158 and a second arcuate portion 160. Recessed surface 155 is substantially L-shaped at first arcuate portion 158 and thus includes a leg 162, which may be referred to as axial leg 162, extending axially from upper end 110 and a leg 164, referred to as radial leg 164, extending radially inwardly from outer surface 106 until it intersects axial leg 162. Radially inwardly extending grooves 166, having a slightly greater arc length than tongues 136 and 138, are defined in leg 162 of recessed surface 155 so that tongues 136 and 138 may be received therein.

Recessed surface 155 is also generally L-shaped at second arcuate portion 160. Recessed surface 155 at second portion 160 has a leg 168, referred to as radial leg 168, extending radially inwardly from outer surface 106 of seal element 104. Leg 168 extends radially inwardly a greater distance than leg 164. A leg 170, referred to as axial leg 170, extends axially from upper end 110 until it intersects with leg 168. Leg 170 extends axially a greater distance than leg 162 of first portion 158 of recessed surface 155.

Recess 156 at lower end 112 of sealing element 104 defines recessed surface 157, and includes a first arcuate portion 172 and a second arcuate portion 174. Recessed surface 157 is generally L-shaped at both first and second portions 172 and 174. At first portion 172, recessed surface 157 has a leg 175, referred to as axial leg 175, extending axially from lower end 112 and a leg 176, referred to as radial leg 176, extending radially inwardly from outer surface 106 until it intersects axial leg 175. Radially inwardly extending grooves 177, having a slightly greater arc length than tongues 136 and 138, are defined in leg 175 of recessed surface 157 so that tongues 136 and 138 may be received therein.

Recessed surface 157 at second arcuate portion 174 has a leg 178, referred to as axial leg 178, extending axially from lower end 112 and a leg 180, referred to as radial leg 180, extending radially inwardly from outer surface 106 until it intersects axial leg 176. Legs 178 and 180 have lengths greater than legs 175 and 176, respectively. Second portion 174 of lower recess 156 is positioned radially 180° from second portion 160 of first recess 154 and second portions 160 and 174 each preferably span between 60° and 70°, but the actual angle may vary and be greater or less than 60°–70°, depending on seal element outer diameter.

Bridge elements 182 and 184 are received in recesses 154 and 156 at second portions 160 and 174, respectively. As shown in FIG. 4, bridge elements 182 and 184 preferably have substantially L-shaped cross sections and thus define L-shaped surfaces 183 and 185, respectively. The bridge elements are preferably made from heat-treated steel. Surface 183 is substantially coextensive with recessed surface 155 of first portion 158 of upper recess 154. Surface 185 is substantially coextensive with recessed surface 157 of first portion 172 of lower recess 156.

Figure 1A:
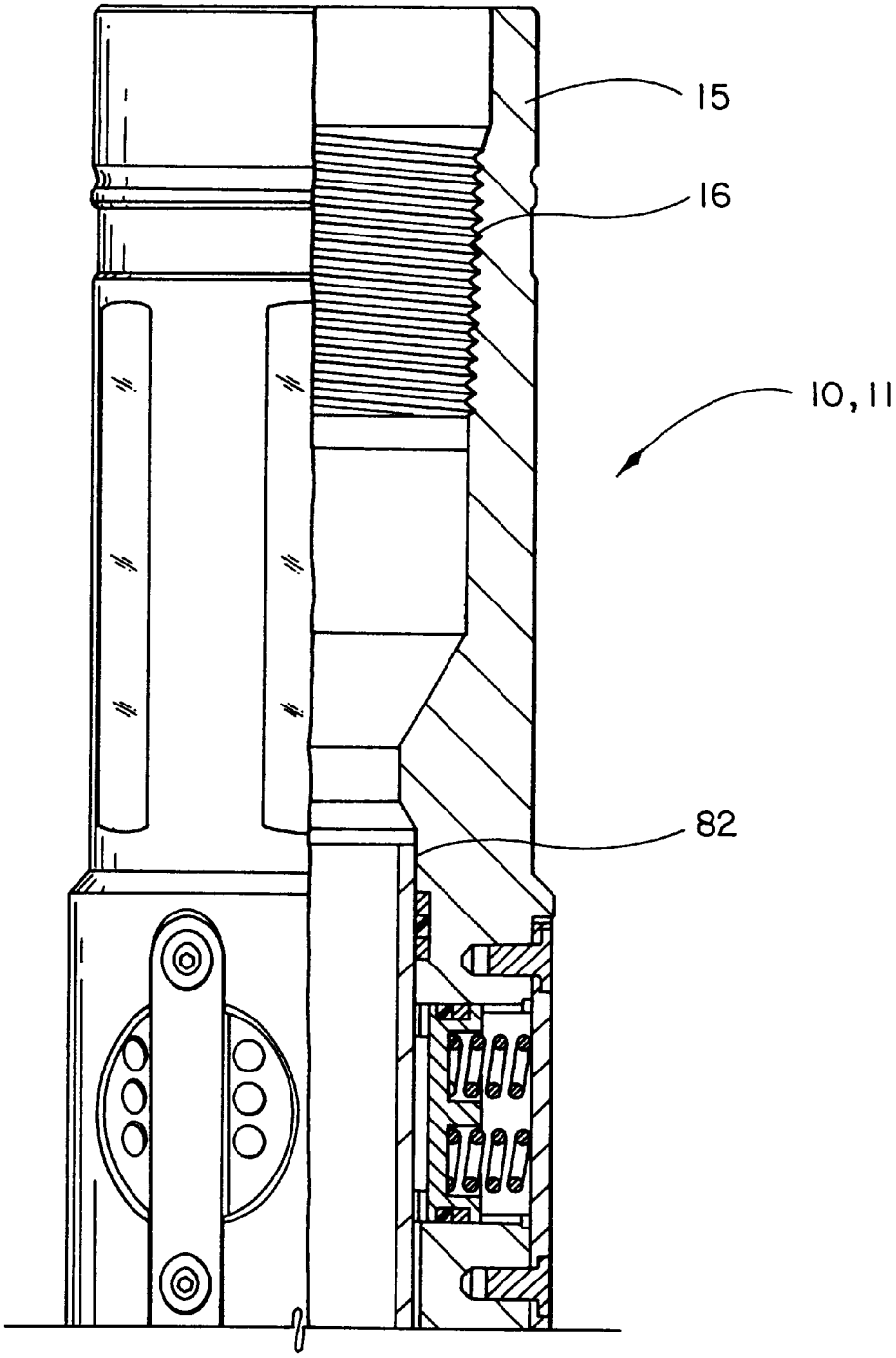
Figure 1B:
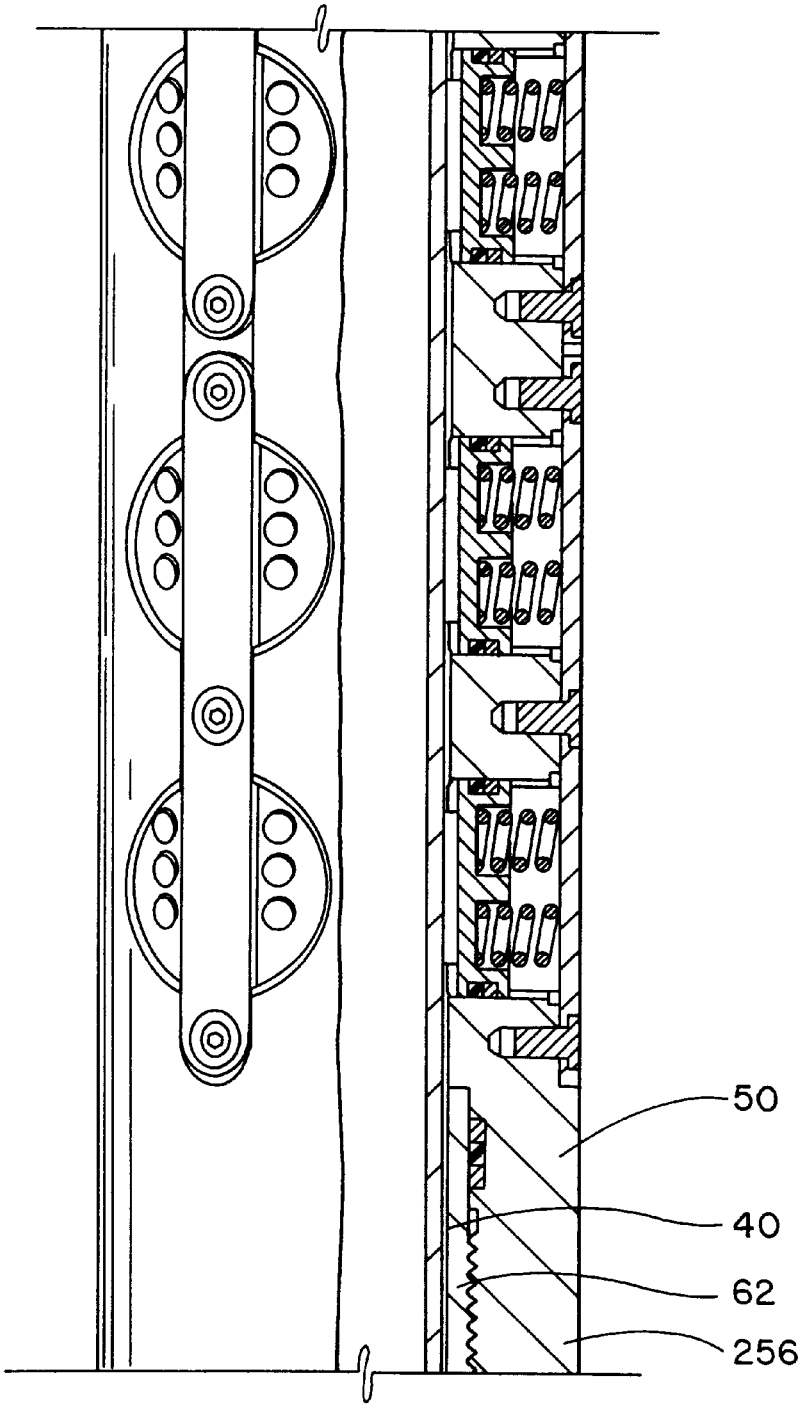
Figure 1C:
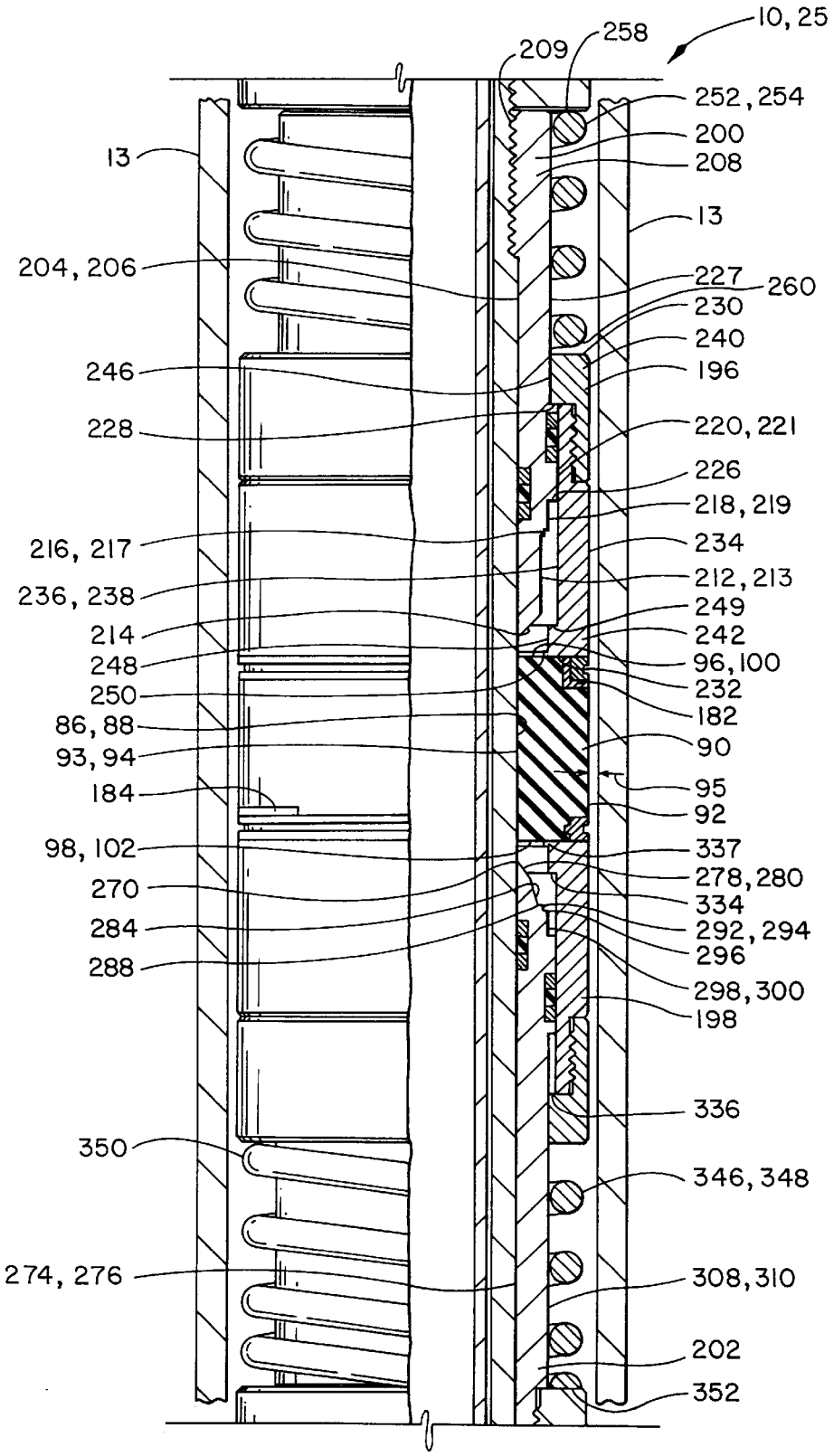
Figure 10:
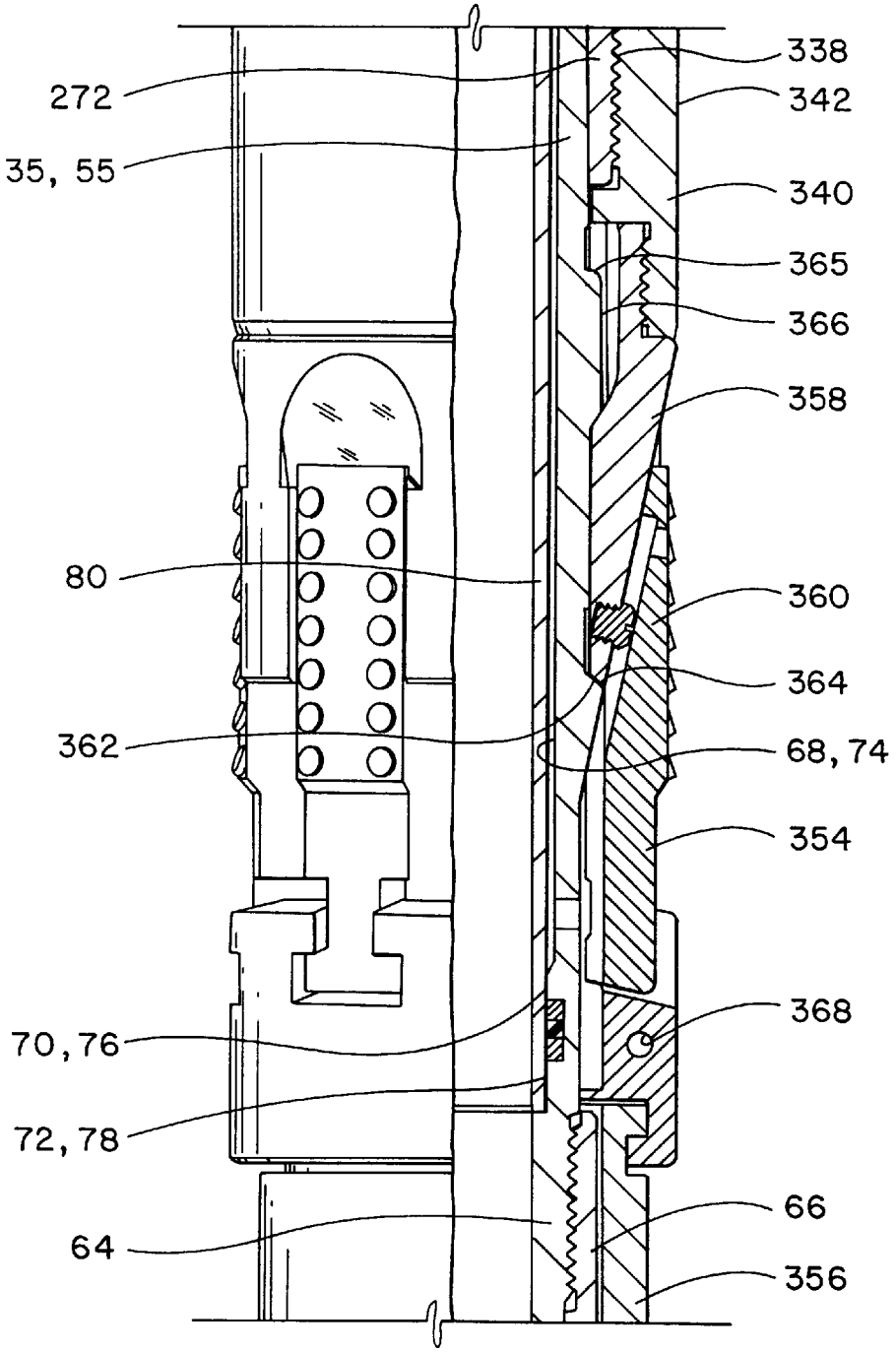
FIG. 10 shows the development of one J-slot of the present invention.
Figure 1E:
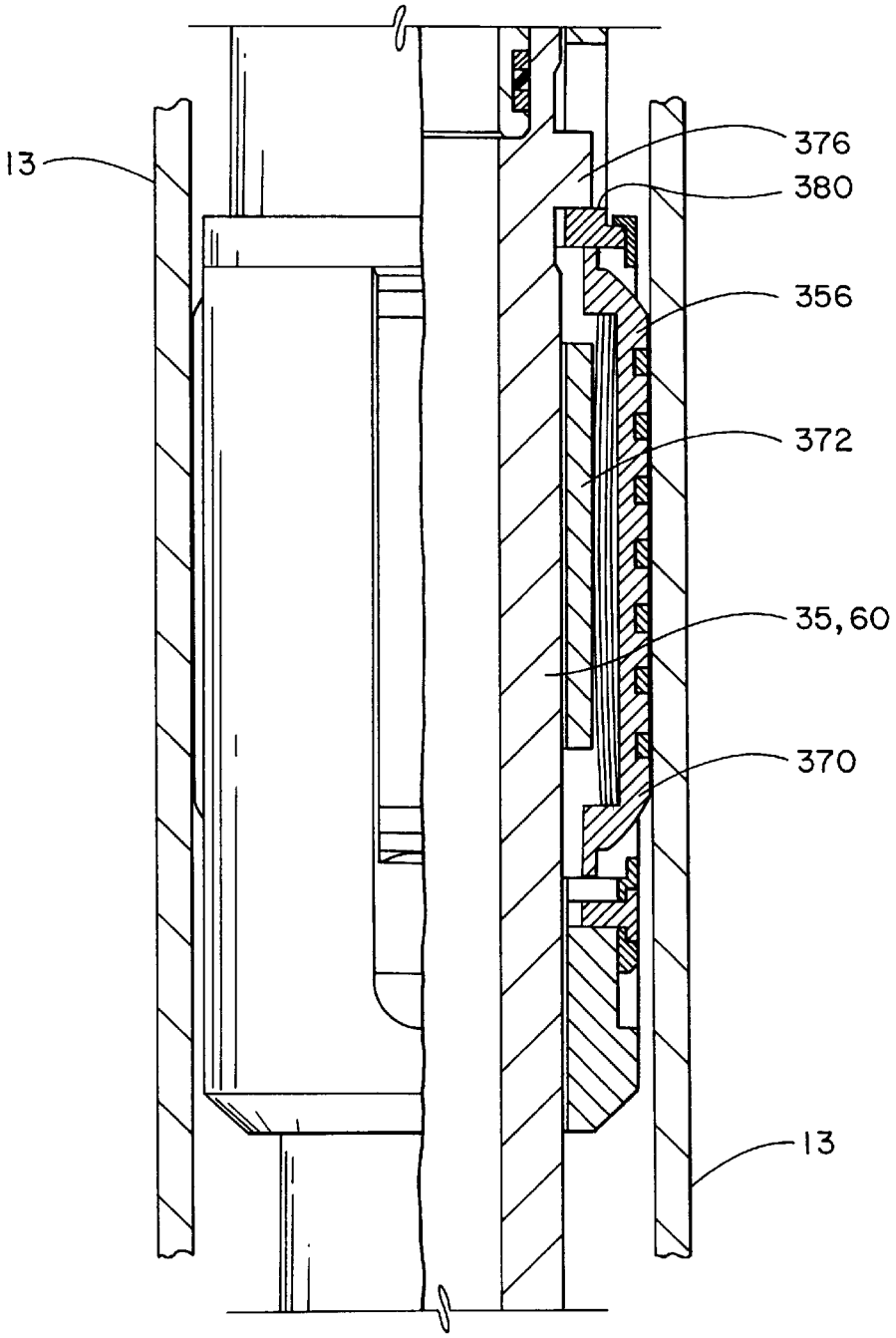
Figure 1F:
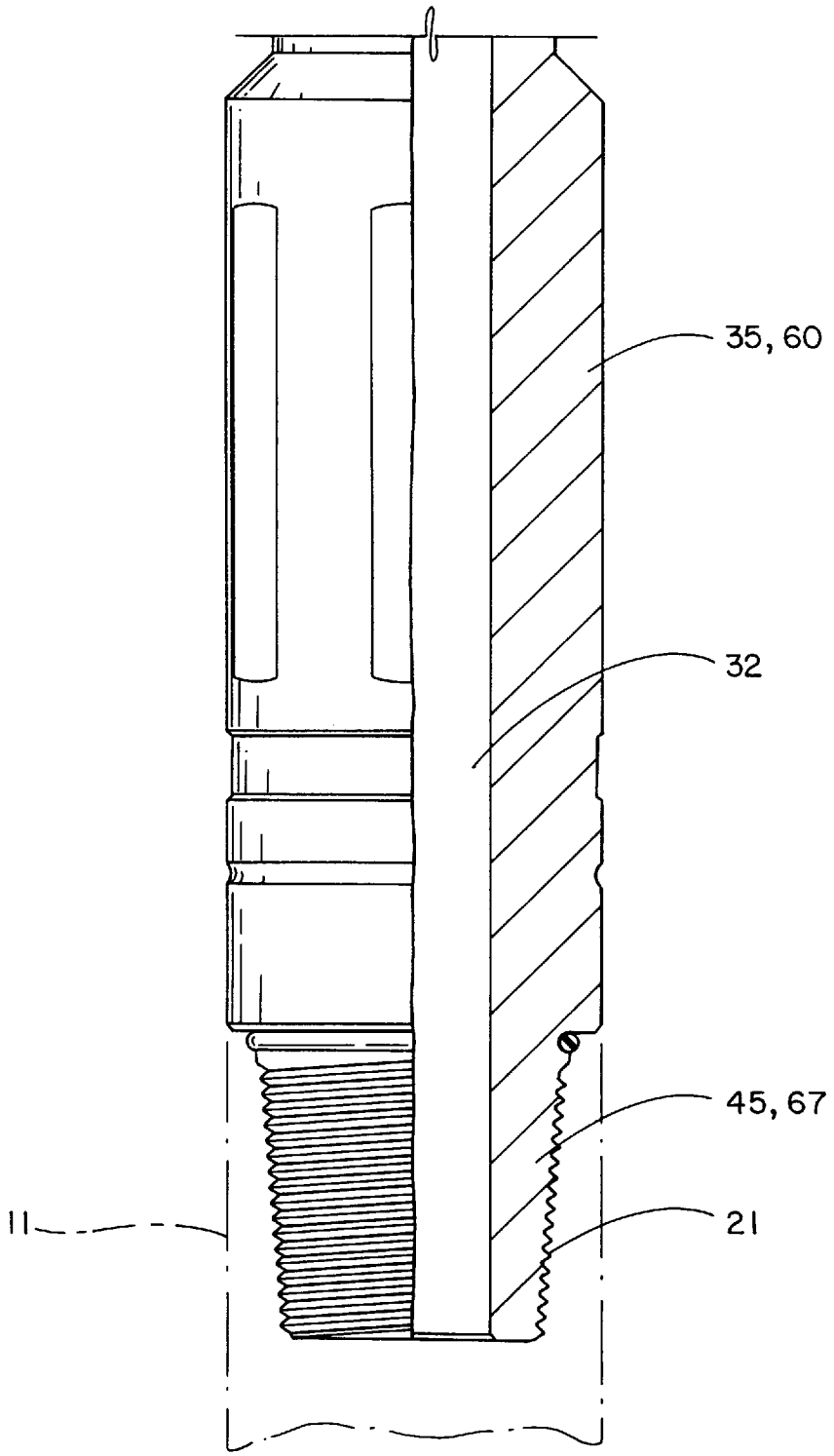
Figure 2A:
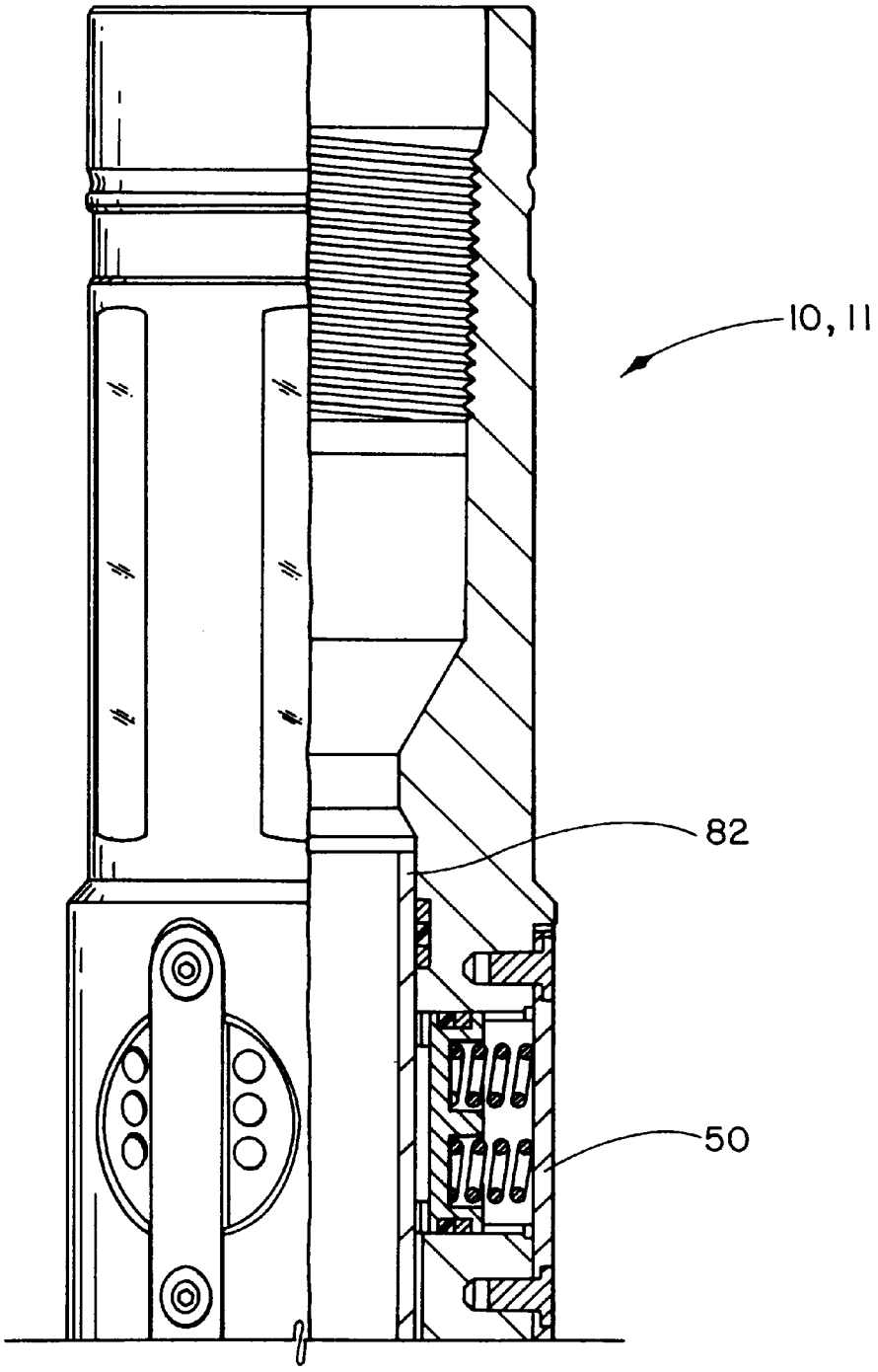
Figure 2B:
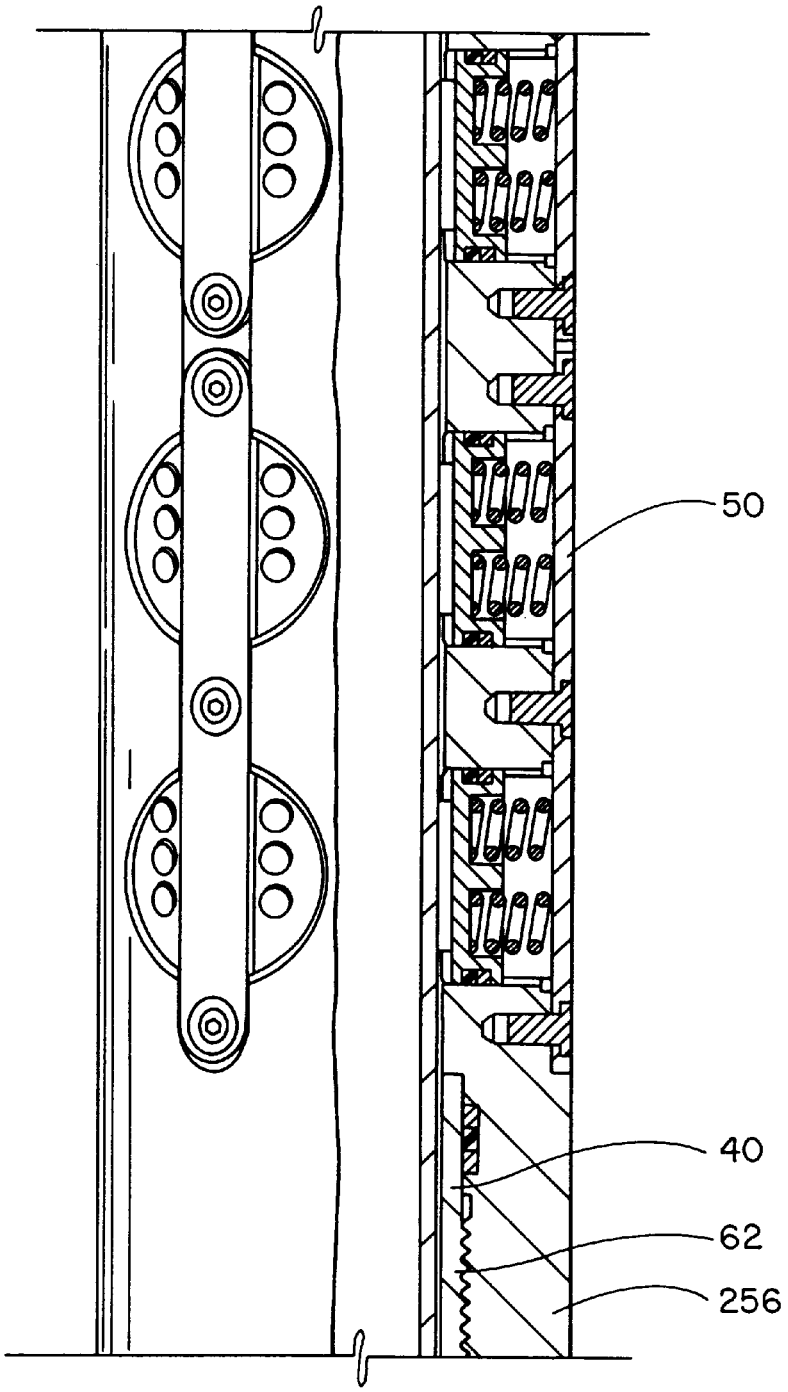
Figure 2C:
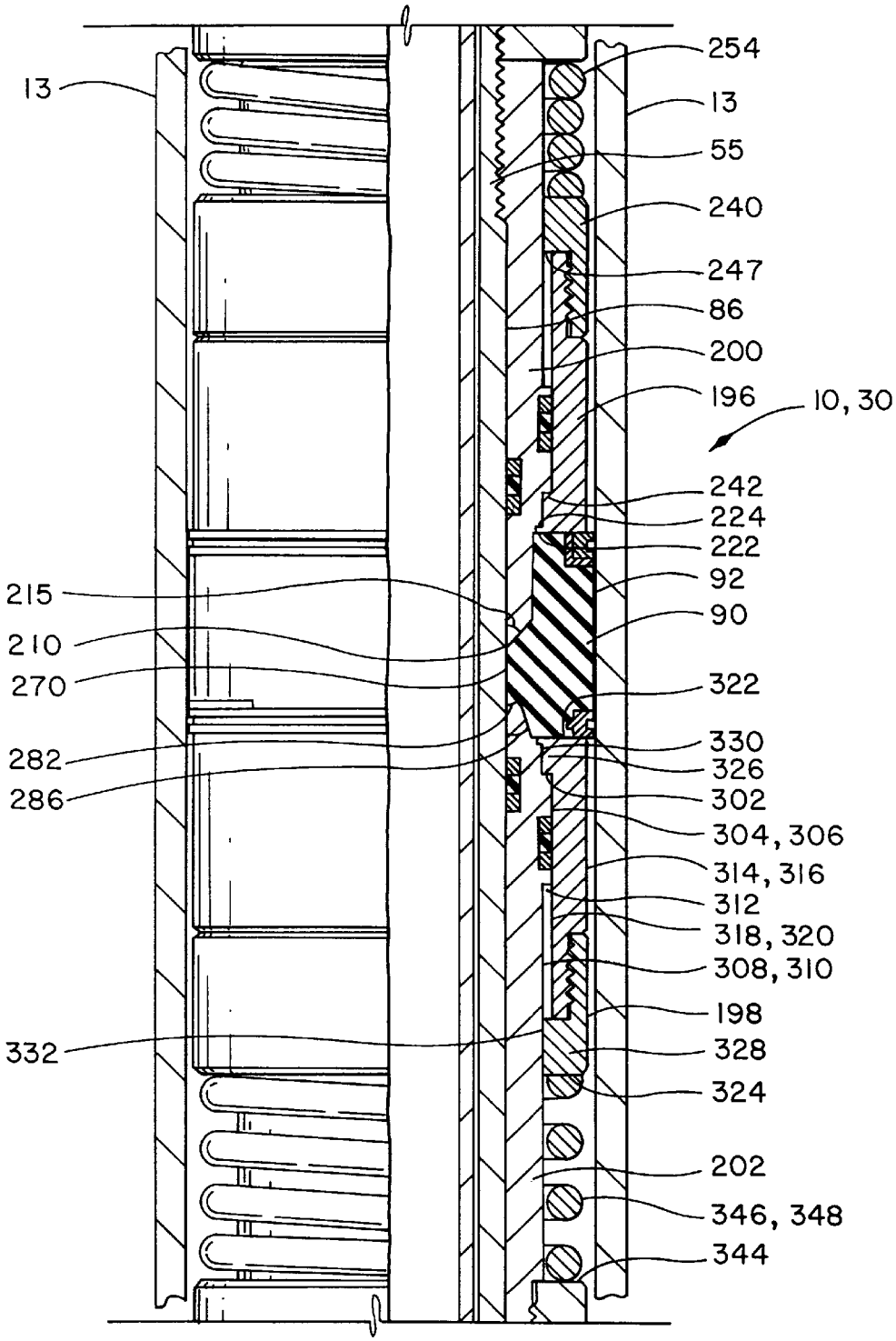
Figure 20:
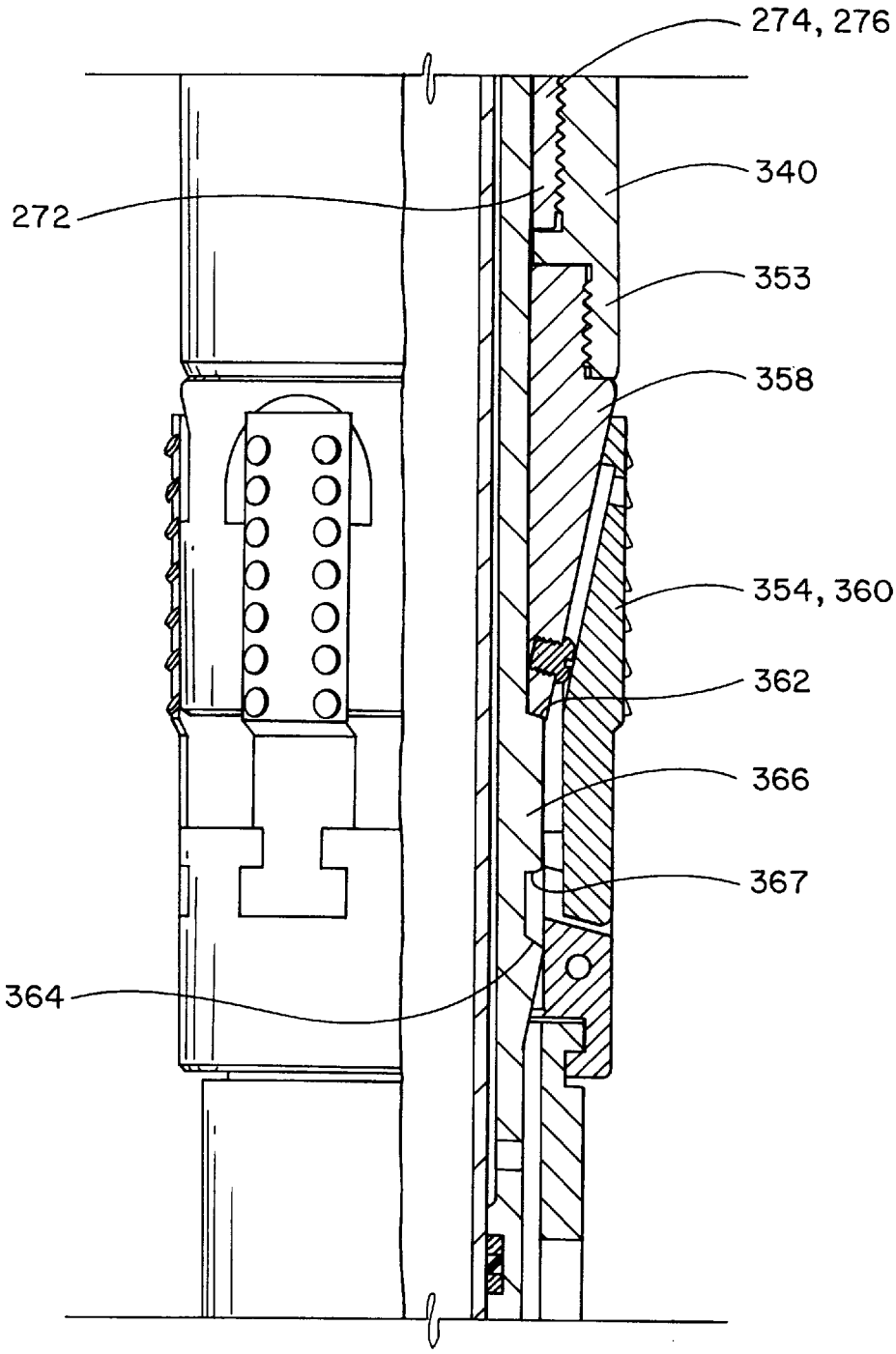
Figure 2E:
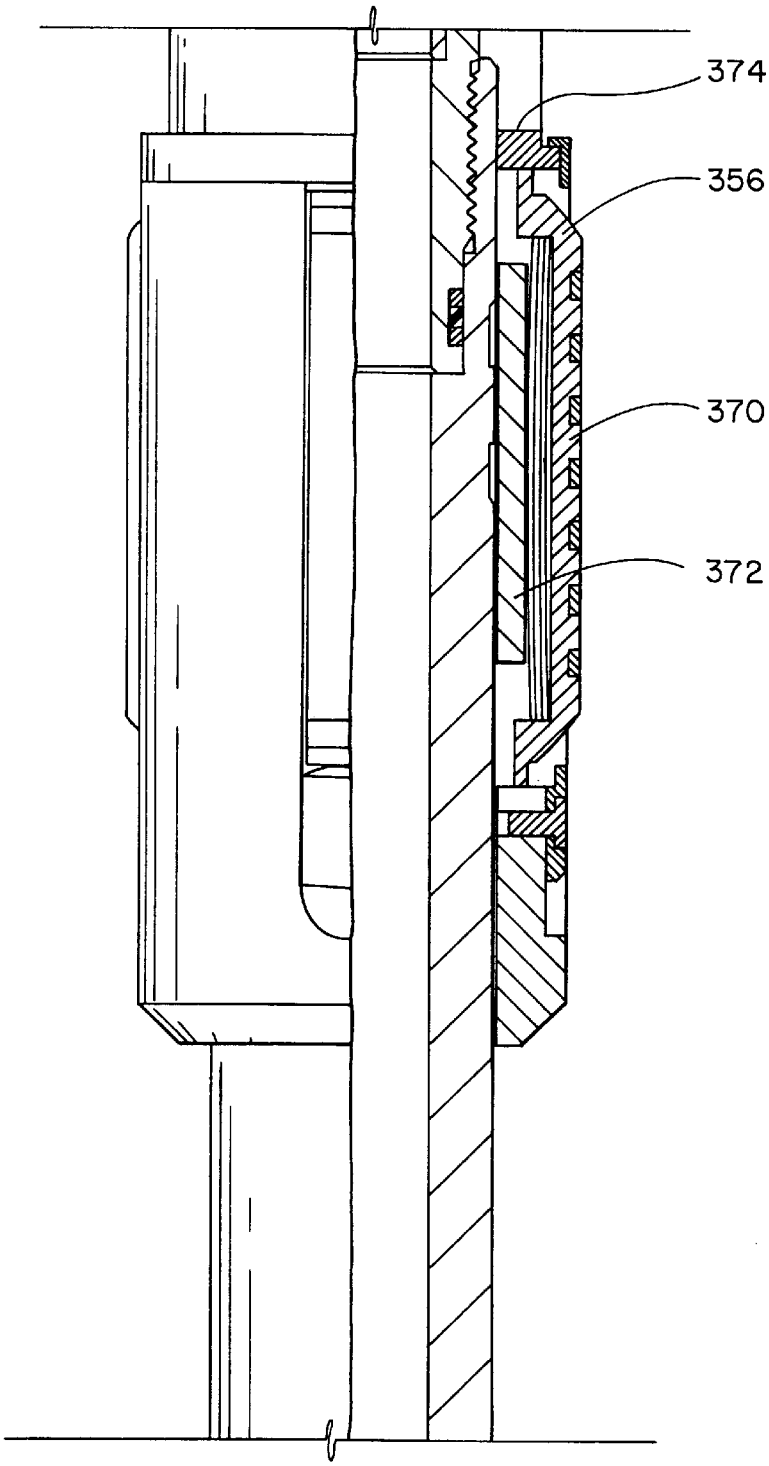
Figure 2F:
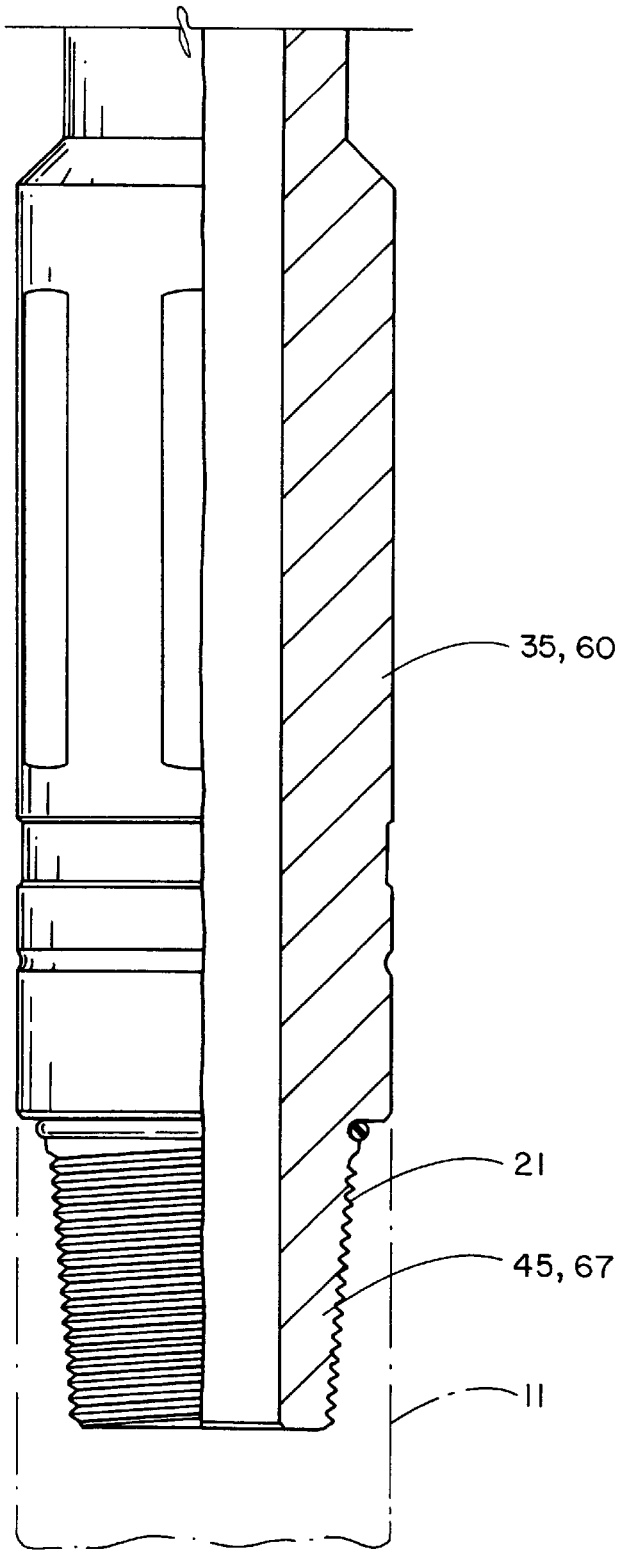
Figure 3:
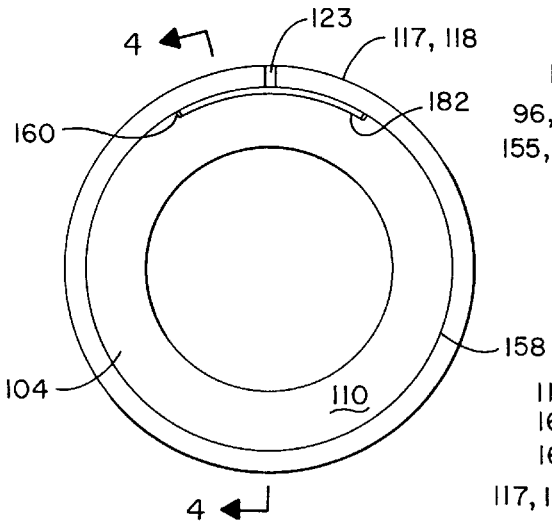
FIG. 3 is a top plan view of the seal assembly of the present invention.

As shown in FIGS. 3 and 10, upper and lower jackets 118 and 120 are disposed in recesses 154 and 156, respectively, so that gap 123 in upper jacket 118 is aligned with bridge element 182, and gap 123 in lower jacket 120 is rotated approximately 180° therefrom and aligned with bridge element 184.

As described earlier, second portions 160 and 174 of recesses 154 and 156, respectively, preferably extend between 60° and 70°, so the L-shaped bridge elements likewise span between 60° and 70° but will have an arcuate length slightly less than the arcuate lengths of second portions 160 and 174. The gaps 123 in upper and lower anti-extrusion jackets 118 and 120 are preferably positioned at the approximate center of the arcuate length of bridge elements 182 and 184, respectively, when the packer apparatus 10 is in running position 25. The arcuate length of gap 123 will be smaller than the arcuate length of bridge elements 182 and 184 when seal assembly 90 is radially expanded to engage casing 13. Thus, ends 122 and 124 of the anti-extrusion jackets will always be disposed in bridge elements 82 and 184 and will never reach the ends of the bridge elements.

Packer apparatus 10 further includes first, or upper and second, or lower pusher shoes 196 and 198, respectively, and first, or upper and second, or lower seal wedges 200 and 202, respectively. Upper seal wedge 200 has an inner surface 204 defining an inner diameter 206, and is closely and sealingly received about upper packer mandrel 55. Upper seal wedge 200 is threadably connected at a joint 208 to upper packer mandrel 55 at an upper end 209 thereof, and has a lower end 210 that is positioned above upper end 96 of seal assembly 90 when packer apparatus 10 is in running position 25. Upper seal wedge 200 has a first outer, or seal engagement surface 212 defining a first outer diameter 213 stepped radially outwardly from surface 86 of packer mandrel 55. A ramp or ramp surface 214 having a ramp angle 215 is provided on upper seal wedge 200 between inner surface 200 and first outer surface 212.

Upper seal wedge 200 has a second outer surface 216 located above and displaced radially outwardly from outer surface 212, a third outer surface 218 located above and displaced radially outwardly from second outer surface 216 and a fourth outer surface 220 located above and displaced radially outwardly from third outer surface 218. Thus, surface 216 defines a diameter 217 having a magnitude greater than diameter 213, surface 218 defines a diameter 219 having a magnitude greater than diameter 217 and surface 220 defines a diameter 221 having a magnitude greater than the magnitude of diameter 219.

A first downward facing shoulder 222 is defined between first and second outer surfaces 212 and 216. A second downward facing shoulder 224 is defined by and extends between second outer surface 216 and third outer surface 218. Finally, a third downward facing shoulder 226 is defined by and extends between third and fourth outer surfaces 218 and 220, respectively. Upper seal wedge 200 has a fifth outer surface 227 located above and recessed radially inwardly from fourth outer surface 226. An upward facing shoulder 228 is defined by and extends between surfaces 220 and 227.

Upper pusher shoe 196 is disposed about upper seal wedge 200 and has a first or upper end 230, a second or lower end 232, an outer surface 234 and an inner surface 236 defining a first inner diameter 238. Outer surface 234 is preferably coextensive with outer surface 92 of seal assembly 90 when packer apparatus 10 is in running position 25. Pusher shoe 196 is slidable relative to upper seal wedge 200, and is disposed thereabout so that inner surface 236 sealingly engages fourth outer surface 220 of upper seal wedge 200.

Pusher shoe 196 has a first or upper head portion 240 defined at the upper end thereof and a second or lower head portion 242 defined at the lower end thereof. Upper head portion 240 defines a second inner diameter 246 radially recessed inwardly from first inner diameter 238 and which has a magnitude smaller than outer diameter 221 defined by fourth outer surface 220 of upper seal wedge 200. Lower head portion 242 defines a third inner diameter 248 radially recessed inwardly from first inner diameter 238. Thus, a downward facing shoulder 247 is defined by and extends between diameters 246 and 238, and an upward facing shoulder 249 is defined by and extends between diameters 238 and 248. An anti-extrusion lip 250 extends radially inwardly from head portion 242 and engages upper radial surface 100 of seal assembly 90.

An upper biasing means 252 is disposed about upper seal wedge 200 above pusher shoe 196. Biasing means 252 may comprise a spring 254 disposed between hydraulic hold-down assembly 50 and upper pusher shoe 196. The lower portion of hydraulic hold-down assembly 50 may be referred to as a stop ring 256 which engages an upper end 258 of spring 254. A lower end 260 of spring 254 is adapted to engage the upper end 230 of pusher shoe 196. Spring 254 is always in compression and thus urges pusher shoe 196 downward so that lower end 232 thereof is in constant engagement with seal assembly 90 both in the running and set positions 25 and 30, respectively.

Lower seal wedge 202 has an upper end 270, a lower end 272 and an inner surface 274 defining an inner diameter 276. Lower seal wedge 202 is closely received about and sealingly engages upper packer mandrel 55. Upper end 270 of seal wedge 202 is positioned below lower end 98 of seal assembly 90 when packer apparatus 10 is in running position 25.

Lower seal wedge 202 has a first outer or angular seal engaging surface 278 which may be referred to as a ramp or ramp surface 278. Ramp surface 278 extends downward from upper end 270 of seal wedge 202 and radially outwardly from inner surface 274 thereof, and thus radially outwardly from outer surface 86 of upper packer mandrel 55. Ramp surface 278 may have a first ramp portion 280 having a ramp angle 282 and a second ramp portion 284 extending downwardly from first ramp portion 280 and having a second ramp angle 286. Ramp 278 and terminates at an upward facing shoulder 288. Preferably, the radially outermost part of ramp 278, where ramp 278 intersects shoulder 288, defines a diameter substantially equivalent to or slightly less than diameter 213 of surface 212 of upper seal wedge 200.

Lower seal wedge 202 has a second outer surface 292 defining a diameter 294. Shoulder 288 extends between ramp surface 278 and second outer surface 292. Second outer surface 292 extends downwardly from shoulder 288 and terminates at an upward facing shoulder 296 which is defined by and extends between second outer surface 292 and a third outer surface 298. Third outer surface 298 defines an outer diameter 300. Third outer surface 298 extends downwardly from shoulder 296 and terminates at an upward facing shoulder 302 which is defined by and extends between third outer surface 298 and a fourth outer surface 304 which defines a diameter 306. Fourth outer surface 304 extends downwardly and terminates at a downward facing shoulder 312 defined by and extending between surface 304 and a fifth outer surface 308. Fifth outer surface 308 defines a diameter 310 recessed radially inwardly from diameter 306.

Lower pusher shoe 198 is disposed about and slidable relative to lower seal wedge 202, and has a first inner surface 318 defining a first inner diameter 320 closely received about and sealingly engaged with fourth outer surface 304 of lower seal wedge 202. Lower pusher shoe 198 has an outer surface 314 defining an outer diameter 316. Outer surface 314 is preferably coextensive with outer surface 92 of seal assembly 90 when packer apparatus 10 is in running position 25. Lower pusher shoe 198 has a first or upper end 322 and a second or lower end 324. A first or upper head portion 326 is defined at first end 322 and a second or lower head portion 328 is defined at lower end 324. First or upper head portion 326 defines a second inner diameter 330 recessed radially inwardly from first inner diameter 320. Second or lower head portion 328 defines a third inner diameter 332 radially recessed inwardly from first inner diameter 320. Thus, a downward facing shoulder 334 is defined by and extends between first and second diameters 320 and 330, and a upward facing shoulder 336 is defined by and extends between first inner diameter 320 and third inner diameter 332. A lower anti-extrusion lip 337 extends radially inwardly from upper head portion 326 and engages lower radial surface 102 of seal assembly 90.

Lower seal wedge 202 is threadedly connected at its lower end 272 to a stop ring 340 at a threaded joint 338. Stop ring 340 has an outer surface 342 stepped radially outwardly from fifth outer surface 308 of lower seal wedge 202 and has an upper end 344. A biasing means 346 is disposed about lower seal wedge 202 and is positioned between lower pusher shoe 198 and upper end 344 of stop ring 340. Biasing means 346 may comprise a spring 348 having an upper end 350 and a lower end 352. Spring 348 is in compression when packer apparatus 10 is in running position 25 to urge pusher shoe 198 upwardly so that upper end 322 thereof is in constant engagement with radial surface 102 defined by lower end 98 of seal assembly 90.

Stop ring 340 is connected at a lower end 353 thereof to a slip assembly 354 that is in turn connected to a drag block assembly 356. Slip assembly 354 and drag block assembly 356 are of a type known in the art. Thus, slip assembly 354 may include a slip wedge 358 disposed about packer mandrel 35 and a plurality of slips 360 disposed about slip wedge 358. A lower end 362 of slip wedge 354 may engage a generally upwardly facing shoulder 364 defined on the outer surface of packer mandrel 55 when packer apparatus 10 is in running position 25. Shoulder 364 preferably extends around the entire circumference of packer mandrel 55. Packer mandrel 55 may also have a pair of lugs 366 having upper and lower ends 365 and 367, respectively, defined on the outer surface thereof and positioned 1800 apart. Thus, slip wedge 358, which is slidable relative to mandrel 55 may have slots therein to allow wedge 358 to slide relative to the packer mandrel. Such a configuration and the operation thereof are well known in the art.

Figure 7:
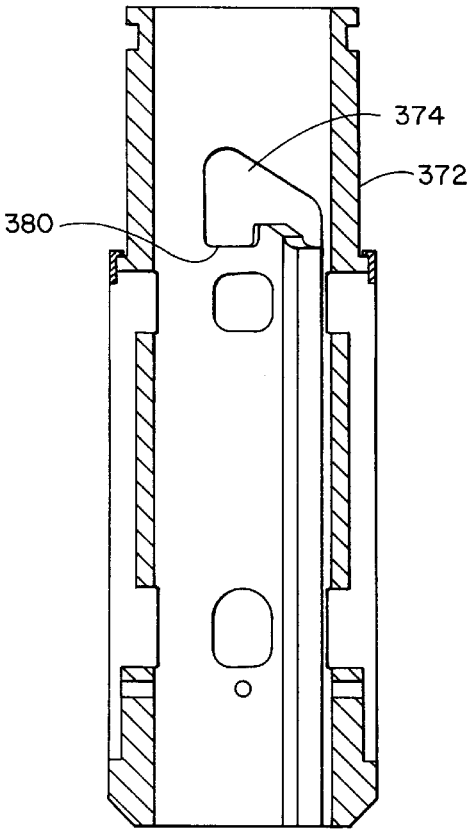
FIG. 7 shows a cross-sectional view of a drag block sleeve showing the J-slot.
Figure 8:
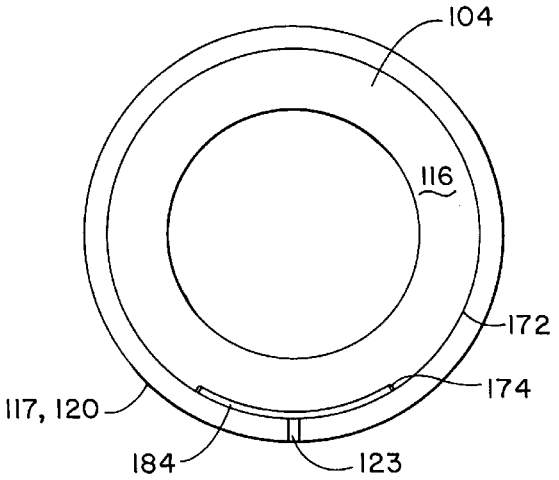
FIG. 8 is a bottom plan view of the seal assembly of the present invention.
Figure 10:
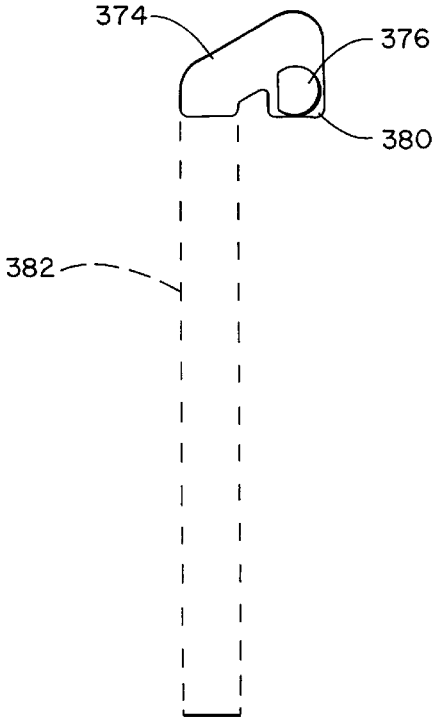

Slip assembly 354 may be connected to drag block assembly 356 with a split ring collar 368. Drag block assembly 356 preferably includes four drag blocks 370, and includes a drag block sleeve 372 with a pair of automatic J-slots 374 defined therein. J-slots have a short leg 380 and a long leg 382. A pair of radially outwardly extending lugs 376 are defined on lower packer mandrel 60. As is known in the art, lugs 376 are preferably disposed 180° apart and rest in short legs 380 of J-slots 374 when packer apparatus 10 is in running position 25. A typical drag block sleeve, with automatic J-slots 374 is shown in cross section in FIG. 7. A development of the J-slots is shown in FIG. 10. The dashed lines in FIG. 10 indicate that the long leg may not be machined completely through, but need only be deep enough to allow the lugs 376 to travel up and down therein.

The operation of the packer apparatus 10 is as follows. Packer apparatus 10 is lowered on tubing string 11 into wellbore 12 having casing 13 disposed therein. The drag blocks 370 engage inner surface 14 of casing 13 as packer apparatus 10 is lowered into the wellbore. Once packer apparatus 10 has reached the location in wellbore 12 where it is desired to move packer apparatus 10 to set position 30, tubing string 11 is pulled upwardly, which causes the hydraulic hold-down assembly 50 and thus the packer mandrel 35 to be pulled upward. Friction between drag blocks 370 and casing 13 holds drag block assembly 356 in place while the packer mandrel is moved upwardly. Packer mandrel 35 is moved upward and rotated so that lugs 376 are positioned above long legs 382 of J-slots 374. The upward pull is then released and packer mandrel 35 is allowed to move downwardly. Upper seal wedge 200 is fixedly connected to packer mandrel 35 so that as packer mandrel 35 moves downwardly, seal wedge 200 likewise moves downwardly. Upper spring 254 will urge pusher shoe 200 downwardly which in turn causes a downward force on seal assembly 90 and lower pusher shoe 202. The downward force is transmitted into lower spring 348 which urges stop ring 340 and thus wedge 358 downward. As wedge 358 moves downward, it expands slips 360 outwardly until the slips ultimately engage and grab casing 13.

Packer mandrel 35 continues to move downwardly after slips 360 engage casing 13. Lower end 210 of upper seal wedge 200 will engage and begin to slide between seal assembly 90 and outer surface 96 of packer mandrel 55, thus expanding seal assembly 90 radially outwardly. As the packer mandrel continues to move downward, upper seal wedge 200 and upper pusher shoe 196, which is being urged downward by spring 254, will also cause seal assembly 90 to slide downwardly. Because lower seal wedge 202 is slidable relative to upper packer mandrel 55, and is fixed in place and cannot move downward in set position 30, seal assembly 90 will engage upper end 270 of lower seal wedge 202 and will slide over ramp surface 278 as seal assembly 90 is urged downwardly.

Because the packer apparatus has both upper and lower seal wedges, the outer surface 92 of the seal assembly 90 is encouraged to engage the casing first at the upper and lower ends 96 and 98 thereof. As the packer mandrel continues to move downwardly, upper and lower seal wedges 200 and 202 will slide between and thus be inserted between seal assembly 90 and surface 86 of upper packer mandrel 55 so that inner surface 94 thereof is engaged by ramp surface 214 and first outer or seal engagement surface 212 of upper seal wedge 200, and by ramp surface 278 of lower seal wedge 202. The upper and lower seal wedges thus radially expand the inner diameter of seal assembly 90 which forces the seal assembly 90 radially outwardly into engagement with the casing 13. Upper and lower seal wedges 200 and 202 each will be inserted between seal assembly 90 and outer surface 96 of upper packer mandrel 35 for at least a portion of length 99, and upper seal wedge 200 preferably extends for at least one-half the length of seal assembly 90 when packer apparatus 10 is in set position 30.

In the set position, anti-extrusion lip 250 on upper pusher shoe 196 will engage shoulder 224 on upper seal wedge 200 and anti-extrusion lip 337 on lower pusher shoe 198 engages shoulder 296 on lower seal wedge 202. Thus, in the set position, seal assembly 90 is engaged by ramp surface 214, seal surface 212, and shoulder 222 of seal wedge 200, and is engaged also by anti-extrusion lip 250 and lower head portion 242 of pusher shoe 196. Shoulder 222, anti-extrusion lip 250 and head portion 242 provide a substantially continuous surface at upper end 96 of seal assembly 90 with no gaps to prevent any seal extrusion.

Seal assembly 90 is also engaged in the set position by ramp surface 278 and shoulder 288 on lower seal wedge 202, and by anti-extrusion lip 337 and upper head portion 326 of lower pusher shoe 198, which provides a substantially continuous surface in the set position to prevent any seal extrusion at the lower end 98 of seal assembly 90. When packer apparatus 10 is in set position 30, gap 123 between ends 122 and 124 of anti-extrusion jackets 118 and 120 will increase but will still define an arcuate length less than the arcuate length of bridge elements 182 and 184. Thus, bridge elements 182 and 184 will engage the casing at the location of the gaps 123 in the anti-extrusion jackets so that bridge elements 182 and 184 and anti-extrusion jackets 118 and 120 prevent seal extrusion at the casing 13. Extrusion of the seal is thus substantially completely prevented because anti-extrusion jackets 118 and 120, along with bridge elements 182 and 184, will engage casing 13 to prevent seal extrusion at the casing inner surface and since the jackets and bridge elements, along with the pusher shoes and seal wedges encase the upper and lower ends of the seal element between packer mandrel 35 and casing 13.

When packer apparatus 10 is in the set position, seal assembly 90 sealingly engages casing and will operate to maintain a seal at temperature and pressure as extreme as 400° F. and 15,000 psi. If it is desired to remove the packer apparatus from the wellbore or to set the packer apparatus at a different location an upward pull is applied so that packer mandrel 35 will begin to slide upwardly. Shoulder 362 on packer mandrel 35 will engage end 364 of slip wedge 358 and will pull wedge 358 up to allow slips 360 to retract radially inwardly and release the grab on casing 13. Likewise, upward pull will cause upper seal wedge 200 to be pulled upwardly from between outer surface 86 of upper packer mandrel 55 and seal assembly 90 until lower end 210 thereof is positioned above upper end 96 of seal assembly 90. Lower spring 348 will urge pusher shoe 202 upwardly as the packer mandrel is moved upwardly and the seal assembly 90 will slide off of ramp surface 278 of lower seal wedge 202. When lugs 376 reach the top of J-slots 374, rotation will occur and lugs 376 will be positioned above short legs 380 of J-slots 374. Packer mandrel 35 can be set back down and lugs 376 will rest in short legs 380 of J-slots 374. Packer apparatus 10 will be once again in the running position as shown in FIGS. 1A–1F.

Seal assembly 90 will retract radially when seal wedges 200 and 202 are removed from between packer mandrel 35 and seal assembly 90. When seal wedges 200 and 202 are completely axially retracted, seal assembly 90 is closely received about packer mandrel 35 and gap 95 is defined between seal assembly 90 and casing 13. At least one, and preferably both of anti-extrusion jackets 118 and 120 are automatically retractable anti-extrusion jackets which apply a radially inward force sufficient to cause seal assembly 90 to automatically close around packer mandrel 35 when slip wedges 200 and 202 are axially retracted and removed from between packer mandrel 35 and seal assembly 90. The automatically retractable jackets will apply force directed radially inwardly so that the seal assembly will radially retract until inner surface 94 of seal assembly 90 is closely received about packer mandrel 35 along the entire length 99 thereof. The anti-extrusion jackets 118 and 120 are preferably made from titanium which has strength sufficient to prevent extrusion and has the characteristics necessary to apply the radially inward force required to close seal assembly 90 around packer mandrel 35 such that gap 95 exists between seal assembly 90 and the casing when packer apparatus 10 is in the running position. However, any material having the characteristics and qualities necessary to withstand the extreme temperatures and pressures in the wellbore, and which is capable of repeatedly applying sufficient force directed radially inwardly to cause the seal assembly to retract may be used.

The packer apparatus of the present invention achieves results not possible with prior packers having radially expandable seals. The radially expandable seal shown in U.S. Pat. No. 5,603,511 to Kaiser, Jr., et al. (the "Kaiser patent"), is described as a sealing assembly that maintains sealing engagement at temperatures and pressures of 325° F. and 10,000 psi, respectively. The seal between the casing and tubing in the Kaiser patent is caused by the purely radial expansion of the seals and it does not appear that any compressive forces are imparted into the seal from the axial movement of the packer mandrel. It was found that such an arrangement was not feasible when the seal must maintain engagement at a temperature and pressure of 400° F. and 15,000 psi. The thickness of the seal element required to maintain sealing engagement at such a high temperature and pressure was such that the seal was damaged because the seal wedge was required to travel the entire length of the seal.

The resolution of that problem was to provide the packer apparatus of the present invention which has upper and lower seal wedges that urge the ends of the seal assembly into engagement with the casing first. Seal damage or destruction is not a problem since neither the upper nor lower seal wedge is required to travel the entire length of the seal assembly. The upper seal wedge and lower seal wedge are both inserted between the packer mandrel and the inner surface of the seal along at least a portion of the length of the seal assembly, urging the seal into sealing engagement with the casing by radially expanding the inner diameter of the seal assembly which causes the outer diameter to radially expand and engage the casing.

Once the seal assembly engages the casing, it may be necessary to impart more energy into the seal to insure that the seal assembly 90 will maintain its seal with the casing at 400° F. and 15,000 psi. Sometimes as much as 20,000 pounds downward force or more applied by the tubing string may be required to impart the necessary energy to expand the seal and hold the seal assembly 90 into sealing engagement with the casing at such a high temperature and pressure. When such a downward force is applied, compressive forces applied by the springs, the pusher shoes and by the shoulders and ramped surfaces on the upper and lower seal wedges tend to try to radially expand the seal beyond that which would occur simply due to the radial expansion of the inner diameter of the seal. Such compressive forces provide additional energy which helps to urge and hold the seal assembly 90 in sealing engagement with casing 13. Thus, the present invention provides a packer apparatus that seals against a casing by applying compressive forces and radially outwardly directed forces to a seal assembly so that radial expansion of the seal assembly creates and maintains sealing engagement with the casing.

Packer apparatus 10 of the present invention can be set numerous times in a wellbore and will successfully maintain sealing engagement with the casing each time it is set in a wellbore at the extreme temperatures and pressures contemplated. Usage of automatically retractable anti-extrusion jackets, which will automatically retract each time the packer apparatus is moved from the set to the running position, is also an improvement over prior art patents in that the prior art discloses jackets which must have an additional spring or other biasing element wrapped therearound to radially retract or close the seal assembly.

Although the invention has been described with reference to a specific embodiment, the foregoing description is not intended to be construed in a limiting sense. Various modifications as well as alternative applications will be suggested to persons skilled in the art by the foregoing specification and illustrations. It is therefore contemplated that the appended claims will cover any such modifications, applications or embodiments as followed in the true scope of this invention.

What is claimed is:

1. A packer apparatus for sealing between a tubing string and a casing disposed in a wellbore, the packer apparatus comprising:

a packer mandrel adapted to be connected in the tubing string;

an expandable seal assembly disposed about an outer surface of said packer mandrel, said packer apparatus having a running position and a set position, wherein said seal assembly and said casing have an annular gap therebetween when said packer is in said running position and wherein said seal assembly sealingly engages said casing when said packer is in said set position;

an upper seal wedge disposed about said packer mandrel, said upper seal wedge being positioned above said seal assembly when said seal assembly is in said running position; and a lower seal wedge disposed about said packer mandrel, said lower seal wedge being positioned below said seal assembly when said packer apparatus is in said running position, wherein said upper and lower seal wedges slide between at least a portion of said seal assembly and said packer mandrel outer surface to radially expand said seal assembly outwardly into sealing engagement with said casing when said packer apparatus is moved from said running to said set position.

2. The apparatus of claim 1 wherein said lower seal wedge is slidably disposed about said packer mandrel.

3. The packer apparatus of claim 2, said lower seal wedge having an angular seal engaging surface defined thereon extending radially outwardly from said packer mandrel outer surface.

4. The apparatus of claim 1, wherein said upper seal wedge is fixedly attached to said packer mandrel and movable therewith, so that said upper seal wedge slides between said seal assembly and said outer surface of said packer mandrel when said packer mandrel moves downwardly relative to said seal assembly.

5. The apparatus of claim 1 further comprising:

an upper pusher shoe disposed about said upper seal wedge and engaging an upper end of said seal assembly; and a lower pusher shoe disposed about said lower seal wedge and engaging a lower end of said seal assembly.

6. The apparatus of claim 5 further comprising biasing means for biasing said upper and lower pusher shoes into engagement with said seal assembly.

7. The apparatus of claim 5 further comprising a first spring disposed about said upper seal wedge wherein said first spring engages an upper end of said pusher shoe and urges a lower end of said upper pusher shoe into continuous engagement with an upper end of said seal assembly.

8. The apparatus of claim 7, further comprising a second spring disposed about said lower seal wedge, wherein said second spring engages a lower end of said lower pusher shoe and urges an upper end of said lower pusher shoe into continuous engagement with a lower end of said seal assembly.

9. The packer apparatus of claim 1 wherein said seal assembly comprises:

a sealing element having upper and lower ends and inner and outer surfaces, said inner surface of said sealing element being closely received about said outer surface of said packer mandrel;

a first anti-extrusion jacket disposed in a circumferential recess defined at the upper end of said sealing element; and a second anti-extrusion jacket disposed in a circumferential recess defined at the lower end of said sealing element, each said anti-extrusion jacket having an outer surface substantially coextensive with said outer surface of said sealing element, wherein said anti-extrusion jackets engage said casing at the upper and lower ends of said seal assembly to prevent sealing element extrusion when said packer is in said set position.

10. The packer apparatus of claim 9, wherein at least one of said jackets exerts a force directed radially inwardly on said sealing element so that said seal assembly retracts radially inwardly and closes about said packer mandrel when said packer apparatus is moved from said set to said running position.

11. A packer apparatus capable of being alternated between a first, or running position and a second, or set position, for sealing between a tubing string and a casing, the packer apparatus comprising:

a tubular packer mandrel having an outer surface;

a radially expandable seal assembly mounted on said outer surface of said packer mandrel, wherein said seal assembly and a casing disposed in said wellbore have an annular gap therebetween when said packer apparatus is in said running position and wherein said seal assembly is radially expanded in said set position so that an outer surface of said seal assembly sealingly engages said casing, said seal assembly comprising:

a generally annular sealing element having inner and outer surfaces and having first and second ends, said inner surface of said sealing element being disposed about said outer surface of said packer mandrel, said sealing element having a first radially inwardly extending recess defined in the outer surface thereof at the first end thereof, and having a second radially inwardly extending recess defined in the outer surface thereof at the second end thereof;

an arcuately shaped first anti-extrusion jacket having first and second ends defining a gap therebetween disposed in said first recess; and an arcuately shaped second anti-extrusion jacket having first and second ends defining a gap therebetween disposed in said second recess, the radially outermost surface of said first and second anti-extrusion jackets being substantially coextensive with said outer surface of said sealing element, at least one of said first and second anti-extrusion jackets being an automatically radially retractable jacket wherein said automatically radially retractable jacket exerts a force directed radially inwardly on said sealing element so that when said packer apparatus is moved from the set position to the running position, said automatically radially retractable anti-extrusion jacket will cause said seal assembly to radially retract and close around said packer mandrel to create said gap between said seal assembly and said casing in said running position.

12. The packer apparatus of claim 11 wherein both of said first and second anti-extrusion jackets are automatically radially retractable anti-extrusion jackets.

13. The packer apparatus of claim 11, wherein said automatically retractable anti-extrusion jacket is comprised of titanium.

14. The packer apparatus of claim 11 wherein said anti-extrusion jackets have a generally rectangular cross section.

15. The packer apparatus of claim 11 wherein said at least one automatically radially retractable anti-extrusion jacket further comprises a tongue extending radially inwardly from a radially innermost surface thereof, said tongue being received in a groove defined in said recess in which said automatically radially retractable anti-extrusion jacket is disposed.

16. The packer apparatus of claim 15, wherein said tongue has an arcuate length less than the arcuate length of said anti-extrusion jacket.

17. The packer apparatus of claim 15, wherein said automatically radially retractable anti-extrusion jacket has a groove defined in the radially outermost surface thereof.

18. The packer apparatus of claim 11, each said recess having a substantially L-shaped cross section with an axial leg and a radial leg, wherein said recess has first and second portions, the second portion being recessed axially and radially more than the first portion, wherein an arcuately shaped bridge element having a generally L-shaped cross section is received in said second portion of said recess, said bridge element defining a surface substantially coextensive with the surface defined by the axial and radial legs of the first portion of said recess, said bridge element being disposed between said anti-extrusion jacket and said sealing element and being aligned with said gap, wherein said bridge element has an arcuate length greater than the arcuate length of the gap between said first and second ends of said anti-extrusion jackets when said seal assembly is expanded to engage said casing.

19. The packer apparatus of claim 11, wherein said seal assembly is radially expanded by sliding a wedge having a surface radially stepped outwardly from the outer surface of said packer mandrel between said seal assembly and said packer mandrel at both the upper and lower ends of said seal assembly.

20. A packer apparatus for sealing between a tubing string and a casing disposed in a wellbore comprising:

a packer mandrel;

an expandable seal assembly disposed about said packer mandrel, wherein said seal assembly expands radially to engage said casing when said packer apparatus is moved from a running position to a set position, said seal assembly comprising:

a sealing element disposed about said packer mandrel; and automatically retractable anti-extrusion jackets disposed in recesses defined in an outer surface of said sealing element at the upper and lower ends thereof, wherein said anti-extrusion jackets prevent sealing element extrusion at the casing when said seal assembly is expanded, and wherein said automatically retractable anti-extrusion jackets apply a radially inwardly directed force on said sealing element so that said seal assembly will automatically retract radially and close around said packer mandrel when said packer apparatus is alternated to said running position from said set position.

21. The packer apparatus of claim 20, wherein said jackets are comprised of titanium.

22. The packer apparatus of claim 20 wherein said seal assembly is radially expanded by expanding the inner diameter thereof radially outwardly.

23. The apparatus of claim 22 wherein said seal is urged into sealing engagement with said casing by said radial expansion of said inner diameter and by axial compressive forces applied to the ends of said seal assembly.

24. The packer apparatus of claim 20, wherein said seal assembly is expanded by inserting a wedge between the packer mandrel and an inner surface of the seal assembly at both the upper and lower ends of said seal assembly.

* * * * *